US008772222B2

(12) United States Patent
Baker et al.

(10) Patent No.: US 8,772,222 B2
(45) Date of Patent: Jul. 8, 2014

(54) CLEANING AGENT COMPOSITIONS FOR REDUCING MRSA TRANSMISSION

(71) Applicants: Shanna Baker, Las Vegas, NV (US); Cornelius Johnson, Las Vegas, NV (US)

(72) Inventors: Shanna Baker, Las Vegas, NV (US); Cornelius Johnson, Las Vegas, NV (US)

( * ) Notice: Subject to any disclaimer, the term of this patent is extended or adjusted under 35 U.S.C. 154(b) by 48 days.

(21) Appl. No.: 13/705,127

(22) Filed: Dec. 4, 2012

(65) Prior Publication Data

US 2013/0143788 A1 Jun. 6, 2013

Related U.S. Application Data

(60) Provisional application No. 61/630,032, filed on Dec. 5, 2011.

(51) Int. Cl.
*C11D 17/00* (2006.01)

(52) U.S. Cl.
USPC ..... 510/463; 510/389; 510/481

(58) Field of Classification Search
None
See application file for complete search history.

(56) References Cited

U.S. PATENT DOCUMENTS

| | | | | |
|---|---|---|---|---|
| 4,576,729 | A | 3/1986 | Paszek | |
| 4,873,002 | A | 10/1989 | Ibrahim | |
| 5,798,329 | A | 8/1998 | Taylor | |
| 6,090,768 | A | 7/2000 | Delaney | |
| 6,372,708 | B1 | 4/2002 | Kasturi | |
| 7,608,573 | B1 | 10/2009 | Scheuing | |
| 7,939,488 | B2 | 5/2011 | Scheuing | |
| 8,206,761 | B2 | 6/2012 | Kutumian | |
| 8,222,192 | B2 | 7/2012 | Eng | |
| 2006/0165623 | A1* | 7/2006 | Workman et al. | 424/65 |
| 2011/0256249 | A1* | 10/2011 | Campbell et al. | 424/735 |

OTHER PUBLICATIONS

Webpage re "VLCC Anti Ageing Natural Bathing Bar" http://mall.coimbatore.com/bnh/vlcc/antiageningnaturalbathing.htm.

Essential Oil Seeker website, "Essential Oils and MRSA Staph Infections—Part 2" http://www.essentialoilseeker.com/?p=51.

PeoplesRx website, Amy Neuzil, ND, "MRSA Shmersa" http://www.peoplesrx.com/common/news/store_news.asp?task=store_news&SID_store_news=71&storeID=5ab72154906f41d99bdb3286d064ba81.

Treasuredlocks website, "The Truth About Preservatives Including Grapefruit Seed Extract and Parabens" http://www.treasuredlocks.com/trabpringrse.html.

PubMed.gov, Pharmazie. Jun. 1999;54(6):452-6, von Woedtke T, Schlüter B, Pflegel P, Lindequist U, Jülich WD, abstract: "Aspects of the antimicrobial efficacy of grapefruit seed extract and its relation to preservative substances contained" http://www.ncbi.nlm.nih.gov/pubmed/10399191.

Livestrong.com website, Suzanne Robin, "Oil of Oregano and MRSA" http://www.livestrong.com/article/386942-oil-of-oregano-and-mrsa/.

Squidoo.com website, Resist Super Germs with Essential Oils http://www.squidoo.com/supergerms.

Greener Living Products Ltd. Website, "Greener Living Soap Nuts Organic Laundry Detergent" http://www.buysoapnuts.com/.

Wikipedia article on the shrub genus *Sapindus* http://en.wikipedia.org/wiki/Sapindus#Uses.

"Naturally Knocked Up" website, Donielle Baker, "Homemade Laundry Detergent and Fabric Softener" http://www.naturallyknockedup.com/homemade-laundry-detergent/.

"livingnaturally" soapnut shop website http://www.soapnuts.co.uk/buy_essential-oil.html.

* cited by examiner

*Primary Examiner* — Necholus Ogden, Jr.

(57) ABSTRACT

Antibacterial cleaning agent having principally natural active ingredients includes water, soap-nut-derived saponins, polysorbate 20, glycerin, a mixture of essential oils of lemongrass, tea tree, geranium, lavender, and oregano, and extract of grapefruit seed; methods of laundering, cleaning, and bathing using the cleaning agent.

13 Claims, No Drawings

CLEANING AGENT COMPOSITIONS FOR REDUCING MRSA TRANSMISSION

This application claims the benefit of earlier-filed U.S. Provisional Patent Application No. 61/630,032, filed 5 Dec., 2011, inventors Shanna Baker and Cornelius Johnson.

BACKGROUND OF THE INVENTION

1. Field of the Invention

The present invention relates to cleaning and conditioning agents, more particularly to household cleaning agents, laundry conditioning agents, and personal care products, and especially to laundry soaps.

2. General Background and State of the Art

U.S. Pat. Nos. 7,939,488 and 7,608,573 describe household cleaning agents.

U.S. Pat. No. 6,372,708 describes household cleaning agents and addresses consumers' reliance on suds as an indicator that enough detergent has been applied.

U.S. Pat. Nos. 6,090,768 and 5,798,329 describe laundry detergents.

U.S. Pat. No. 4,873,002 describes a liquid detergent and fabric conditioner.

U.S. Pat. No. 4,576,729 describes a liquid disinfectant laundry detergent.

U.S. Pat. No. 8,206,761 describes a multipurpose cleaning composition comprising white vinegar and essential oils such as oils of eucalyptus, lemon, lavender, and grapefruit.

U.S. Pat. No. 8,222,192 describes composition for cleansing skin comprising an emulsifiable organic solvent, such as ethanol or isopropyl alcohol, water, sodium benzoate, and a natural essential oil a multipurpose cleaning composition comprising white vinegar and essential oils such as oils of eucalyptus, lemon, lavender, and grapefruit.

Soap nuts are discussed with reference to laundry detergents. See Greener Living Products Ltd. Website, "Greener Living Soap Nuts Organic Laundry Detergent," http://www.buysoapnuts.com/. See the Wikipedia article on the shrub genus *Sapindus*, http://en.wikipedia.orq/wiki/*Sapindus*#Uses. See the article, "Homemade Laundry Detergent and Fabric Softener," on the website, "Naturally Knocked Up," http://www.naturallyknockedup.com/homemade-laundry-detergent/, this latter article containing miscellaneous web log postings referencing MRSA.

A website sells soap nuts for cleaning clothes, and also sells essential oils. See "livingnaturally" soapnut shop website, http://www.soapnuts.co.uk/buy essential-oil.html. Appended testimonials reference the addition of an essential oil to a soap mixture to endow it with a pleasing scent.

U.S. Patent Application Publication 20110256249 mentions extract of *Sapindus Mukurossi* fruit, known as soap nut, as providing a less irritating alternative to modern chemical formulations and as having cleansing, anti-bacterial, and anti-fungal properties attributed to its saponin content. That patent application mentions Saponins as having properties including foaming, emulsifying, pharmacological, medicinal, antimicrobial, insecticidal, spermicidal, and molluscicidal activities. That application also mentions essential oils including those of Tea Tree, lavender, and lemongrass.

A webpage displaying the date 2012 advertises a bath bar soap containing oils of geranium and grapefruit. See "VLCC Anti Ageing Natural Bathing Bar," http://mall.coimbatore.com/bnh/vlcc/antiageningnaturalbathing.htm.

Essential oils including, e.g., lemongrass oil, are discussed with reference to MRSA on the Essential Oil Seeker website, "Essential Oils and MRSA Staph Infections—Part 2" http://www.essentialoilseeker.com/?p=51.

Grapefruit seed extract is discussed as killing MRSA. See PeoplesRx website, http://www.peoplesrx.com/common/news/store_news.asp?task=store_news&SID_store_news=71&storeID=5ab72154906f41d99bdb3286d064ba81. Preservative and antimicrobial effects of grapefruit seed extract are discussed, see "The Truth About Preservatives Including Grapefruit Seed Extract and Parabens," Treasuredlocks website, http://www.treasuredlocks.com/trabpringrse.html, and may also be controversial, see "Aspects of the antimicrobial efficacy of grapefruit seed extract and its relation to preservative substances contained," PubMed.gov, http://www.ncbi.nlm.nih.gov/pubmed/10399191.

Oregano oil is discussed for effectiveness against MRSA. See Livestrong.com website, "Oil of Oregano and MRSA," http://www.livestrong.com/article/386942-oil-of-oregano-and-mrsa/.

Blending of essential oils with MRSA in mind is also discussed. See, e.g., Squidoo.com website, Resist Super Germs with Essential Oils," http://www.squidoo.com/supergerms.

INVENTION SUMMARY

It is an object of the present invention to provide superior cleaning and conditioning agents, household cleaning agents, laundry conditioning agents, personal care products, and laundry soaps.

In accordance with these objects and with others which will be described and which will become apparent, an exemplary embodiment of the cleaning agent in accordance with the present invention comprises a soapy composition, said soapy composition being prepared by boiling soap nuts in water for thirty minutes (30 min.), the proportion being two soap nuts per cup (237 ml) of water, thereafter compressing the mixture to reduce the soap nuts to a pulp, and filtering the composition until it is substantially free of soap nut pulp; a volume of glycerin substantially equal to the volume of soapy composition; first, second, third, and fourth volumes of oils, each of said volumes substantially equal to one half teaspoon (2.46 ml) of essential oil per three pints (1420 ml) of soapy composition, said oils being selected from the group including lemongrass essential oil, geranium essential oil, tea tree essential oil, lavender oil, myrrh oil, and oregano oil; and a volume of polysorbate 20 substantially equal to four times the combined volumes of the oils.

Preferably, deionized or distilled water is used.

In a preferred embodiment of the cleaning agent in accordance with the present invention, the oils selected are lemongrass essential oil, geranium essential oil, tea tree essential oil, and lavender oil.

In another preferred embodiment, liquid grapefruit seed extract is added in a concentration substantially equal to one half teaspoon (2.46 ml) of liquid grapefruit seed extract per three pints (1420 ml) of soapy composition.

Also in accordance with the present invention, an exemplary cleaning agent is made with a diluent comprising approximately 50% by volume of a soapy composition, said soapy composition being prepared by boiling soap nuts in water for thirty minutes (30 min.), the proportion being from 4 to 16 soap nuts per liter of water, thereafter compressing the mixture to reduce the soap nuts to a pulp, and filtering the composition until it is substantially free of soap nut pulp. The diluent also comprises approximately 50% by volume of glycerin. The cleaning agent comprises from 0.02% to 0.32% by volume of each of first, second, third, and fourth essential oils, each of said oils being selected from the group consisting of lemongrass essential oil, geranium essential oil, tea tree essential oil, lavender oil, myrrh oil, and oregano oil; and from 0.3% to 6.0% by volume of polysorbate 20.

In a preferred embodiment of the cleaning agent in accordance with the present invention, the soapy composition is prepared with from 6 to 12 soap nuts per liter of water. The cleaning agent comprises from 0.06% to 0.12% by volume of each of said oils and from 0.6% to 3.0% by volume of polysorbate 20.

In another preferred embodiment of the cleaning agent, the soapy composition is prepared with from 8 to 10 soap nuts per liter of water. The cleaning agent comprises from 0.08% to 0.10% by volume of each of said oils and from 1.3% to 1.5% by volume of polysorbate 20.

In another preferred embodiment of the cleaning agent, deionized water is used. In yet another preferred embodiment, distilled water is used.

In another preferred embodiment of the cleaning agent, the oils are selected as lemongrass essential oil, geranium essential oil, tea tree essential oil, and lavender oil.

Another preferred embodiment of the cleaning agent comprises, in addition to four oils as aforementioned, 0.02% to 0.32% by volume of liquid grapefruit seed extract.

Also in accordance with these objects and with others which will be described and which will become apparent, an exemplary method of cleaning and reducing transfer of unwanted microorganisms in accordance with the present invention includes the steps of providing a cleaning agent, said cleaning agent comprising a diluent comprising approximately 50% by volume of a soapy composition, said soapy composition being prepared by boiling soap nuts in water for thirty minutes (30 min.), the proportion being from 4 to 16 soap nuts per liter of water, thereafter compressing the mixture to reduce the soap nuts to a pulp, and filtering the composition until it is substantially free of soap nut pulp, said diluent also comprising approximately 50% by volume of glycerin; said cleaning agent comprising from 0.02% to 0.32% by volume of each of first, second, third, and fourth essential oils, each of said oils being selected from the group consisting of lemongrass essential oil, geranium essential oil, tea tree essential oil, lavender oil, myrrh oil, and oregano oil; and said cleaning agent comprising from 0.3% to 6.0% by volume of polysorbate 20.

The method includes the steps of dispensing said cleaning agent in an effective quantity in a cleaning procedure and performing the cleaning procedure. In a preferred method in accordance with the present invention, the diluent is made with deionized water; in another preferred method, distilled water.

In another preferred method of cleaning in accordance with the present invention, the step of dispensing includes a step of adding said cleaning agent in an effective quantity to a load of laundry; and said step of performing includes steps of washing, rinsing, and drying the load of laundry.

DETAILED DESCRIPTION OF THE PREFERRED EMBODIMENTS

For a further understanding of the objects and advantages of the present invention, reference should be had to the following detailed description.

Production

A soapy composition is prepared by boiling soap nuts in water for thirty minutes (30 min.), the proportion being two soap nuts per cup (237 ml) of water, thereafter compressing the mixture to reduce the soap nuts to a pulp and filtering the composition until it is substantially free of soap nut pulp. Deionized or distilled water is recommended, to eliminate unintended consequences which could result from the use of hard water or heavily chlorinated water. To the resulting soapy filtrate is added a substantially equal volume of glycerin. To this mixture are added four oils, each in a proportion of substantially equal to one half teaspoon (2.46 ml) of essential oil per three pints (1420 ml) of soapy composition (i.e., per six pints (2840 ml) of the combination of soapy composition and glycerin). Each of said oils is selected from the group consisting of lemongrass essential oil, geranium essential oil, tea tree essential oil, lavender oil, myrrh oil, and oregano oil. Polysorbate 20 is added in a volume substantially equal to four times the combined volumes of the four oils.

In a preferred embodiment of the cleaning agent, liquid grapefruit seed extract is added in a volume substantially equal to the volume of one of the oils. In the inventors' view, grapefruit seed extract preserves the cleaning agent and enhances its action against the spread of human pathogens such as MRSA.

In a preferred cleaning agent in accordance with the present invention, the four oils are selected as lemongrass essential oil, geranium essential oil, tea tree essential oil, and lavender oil. In the inventors' view, this embodiment of the cleaning agent not only acts against the spread of human pathogens such as MRSA, but also provides a non-irritating cleaning agent with a pleasant scent.

In another preferred embodiment of the cleaning agent in accordance with the present invention, a fifth volume of oil, equal to the volume of one of the other oils, is added, said fifth oil being oregano oil. In the inventors' view, oregano oil acts potently with the other oils against the spread of human pathogens such as MRSA.

In an alternative process for making the cleaning agent in accordance with the present invention, a diluent is prepared comprising approximately 50% by volume of a soapy composition, said soapy composition being prepared by boiling soap nuts in water for thirty minutes (30 min.), the proportion being from 4 to 16 soap nuts per liter of water, thereafter compressing the mixture to reduce the soap nuts to a pulp, and filtering the composition until it is substantially free of soap nut pulp. The other approximately 50% by volume of the diluent comprises glycerin.

The cleaning agent is then prepared, using the diluent as a base, to comprise from 0.02% to 0.32% by volume of each of first, second, third, and fourth essential oils, each of said oils being selected from the group consisting of lemongrass essential oil, geranium essential oil, tea tree essential oil, lavender oil, myrrh oil, and oregano oil; and also to comprise from 0.3% to 6.0% by volume of polysorbate 20.

The inventors recommend using deionized or distilled water, to eliminate unintended consequences which could result from the use of hard water or heavily chlorinated water.

A preferred embodiment of the cleaning agent in accordance with the present invention comprises approximately 0.02% to 0.32% by volume of liquid grapefruit seed extract, and is made by adding the grapefruit seed extract to the above mixture. In the inventors' view, grapefruit seed extract preserves the cleaning agent and enhances its action against the spread of human pathogens such as MRSA.

In a preferred cleaning agent in accordance with the present invention, the four oils are selected as lemongrass essential oil, geranium essential oil, tea tree essential oil, and lavender oil. In the inventors' view, this embodiment of the cleaning agent not only acts against the spread of human pathogens such as MRSA, but also provides a non-irritating cleaning agent with a pleasant scent.

In another preferred cleaning agent in accordance with the present invention, approximately 0.085% by volume of a fifth volume of oil is added, said fifth oil being oregano oil. In the inventors' view, oregano oil acts potently with the other oils against the spread of human pathogens such as MRSA. In yet another preferred cleaning agent in accordance with the present invention, 0.02% to 0.32% by volume of liquid grapefruit seed extract is added to this five-oil mixture.

In the inventors' view and based on their experience, the cleaning agent in accordance with the present invention exhibits a combination of favorable performance characteristics. In the inventors' view, smoothness of feel on the skin and controllable and predictable dispensability result from reliance on the combination of saponins, glycerin, and polysorbate 20 for surfactant performance and for viscosity. In the inventors' view, lack of irritation on contact with the skin and pleasant, mild tingling sensation result from the combinations of oils chosen for the cleaning agent in accordance with the present invention. In the inventors' view, this cleaning agent's natural-colored appearance; pleasant, herbal scent; acceptability to persons who are averse to household products having primarily industrial chemical origin; and acceptability to persons who prefer a product featuring naturally derived active ingredients result from its combination of soap nut extract, polysorbate 20, and chosen combination of oils. In the inventors' view, this cleaning agent's tendency to inhibit growth, survival, or transfer of microorganisms, while not completely understood, results substantially from the combined effects of saponins and the chosen combination of oils.

Also in accordance with the present invention, a method of laundering includes the steps of providing an embodiment of the cleaning agent as described herein, dispensing said cleaning agent in an effective quantity in a cleaning procedure, and performing the cleaning procedure. In a preferred method, the step of dispensing includes a step of adding said cleaning agent in an effective quantity to a load of laundry; and said step of performing includes steps of washing, rinsing, and drying the load of laundry.

Materials

Soap nut as used herein refers generally to saponin-containing drupes of shrubs and trees of the genus *Sapindus*. Soap nut is available from sources such as Greener Living Products Ltd., http://www.buysoapnuts.com/; Amazon, http://www.amazon.com. Soap nuts, de-seeded and of the mukorossi and trifoliatus varieties in particular, are recommended and available on the Soap Nuts Pro website at http://www.soapnuts.pro/.

Polysorbate 20 (common commercial brand names include Alkest TW 20 and Tween 20) is a polysorbate surfactant whose stability and relative non-toxicity allows it to be used as a detergent and emulsifier in a number of domestic, scientific, and pharmacological applications. One source of food grade polysorbate 20 is http://www.alibaba.com/showroom/polysorbate-20-food-grade.html.

Glycerin, also known as glycerine and glycerol, is a simple polyol compound, widely available in food grade from such sources as Walgreens drug stores.

Lemongrass essential oil is available from Aura Cacia, http://www.auracacia.com/auracacia/aclearn/eo lemongrass.html; from Essential Oil Exchange, http://www.essentialoilexchange.com/; and from Amazon, http://www.amazon.com.

Geranium essential oil is available from Organic Infusions, Inc., 888-680-9777, http://www.organicinfusionswholesale.com; from NaturesFlavors.com, http://www.naturesflavors.com; and from Amazon, http://www.amazon.com.

Tea tree essential oil is available from Puritan's Pride, 800-645-1030, http://www.puritan.com; from Organic Infusions, Inc., 888-680-9777, http://www.organicinfusionswholesale.com; and from Amazon, http://www.amazon.com.

Lavender oil is available from Vitacost, 800-381-0759, http://www.vitacost.com; and from Amazon, http://www.amazon.com.

Grapefruit seed extract is available from Lucky Vitamin, 18 West Mount Kirk Avenue, Norristown, Pa. 19403—888-635-0474, http://www.luckyvitamin.com; from Amazon, http://www.amazon.com; and from natural food product suppliers generally.

Oregano oil is available from Bio-Alternatives, 834 Richmond Street, Klamath Falls, Oreg. 97601 866-882-0213, http://www.bio-alternatives.net; and from OreganoPro, http://www.oreganopro.com/.

Application as Laundry Soap

The inventors find that it suffices to add the cleaning agent in accordance with the present invention in a volume comparable to that recommended with common commercial liquid laundry soaps. Alternatively, the inventors find that it suffices to add approximately ¼ cup (approximately 60 milliliters) of the cleaning agent per typical automatic washer laundry load and to launder the clothing, bedding, towels, and the like in the customary manner with an automatic washer and dryer. For small volumes of water in a bowl or sink, approximately 5-15 milliliters should suffice.

The inventors find that the cleaning agent in accordance with the present invention removes dirt from clothes and, in the inventors' experience, ended problems an inventor had with skin rashes believed to be MRSA related. Indeed, one of the inventors, a healthcare professional, finds the occurrence of methicillin-resistant *Staphylococcus aureus* (MRSA) *Escherichia coli, Enterobacter aerogenes, Acinetobacter baumannii, Clostridium difficile*, Vancomycin-resistant *Enterococcus*, and *Pseudomonas aerugniosa* quite alarming and has been seeking natural products as resource to reduce the transmission of those pathogens.

In the inventors' view, combined or synergistic actions of saponin (from the soap nuts) and the oils reduces the transfer of microorganisms such as MRSA from clothing, bedding items, and like articles to human beings. As a result, the inventors believe the cleaning agent in accordance with the present invention to be useful for reducing the occurrence of infections at healthcare facilities, schools, day care centers, detention facilities, gyms, hotels, military bases, office buildings, and the like, as well as in the home.

The inventors have been seeking a cleaning agent which is helpful in the above contexts, which contains mostly natural ingredients, which is likely to be accepted by environmentally conscious organizations such as government and universities, which is unlikely to contribute to the burden of industrially derived waste products in sewage and runoff, and which is aesthetically pleasing to use. In the inventors' view, the cleaning agent in accordance with the present invention will be accepted as accomplishing these objects.

Application as Bath Soap

The inventors find that the cleaning agent in accordance with the present invention provides an excellent The inventors find that adding 30-120 milliliters of the cleaning agent in accordance with the present invention to a bath for one person suffices to achieve good cleaning, a pleasant bath aroma, and a mild, pleasant, tingling skin sensation for the duration of the bath. The inventors find the cleaning agent in accordance with the present invention to be non-irritating. The inventors find that adding 120-240 milliliters of the cleaning agent in accordance with the present invention to a bath for one person suffices to provide a bath for avoiding transmission of MRSA.

Application as Hand Soap

The inventors find that dispensing 0.5-5 milliliters of the cleaning agent in accordance with the present invention onto one's hands and lathering the cleaning agent with water suffices to provide an effective hand-washing solution which removes dirt and grease, has a pleasant scent, feels mild, and does not irritate the skin.

Application as Dish Soap

The inventors find that adding 30 milliliters of the cleaning agent in accordance with the present invention to a large bowl or small sink of water suffices to provide an effective washing solution for dishes.

Application as General Cleaning Agent

The inventors find that adding 25-30 milliliters of the cleaning agent in accordance with the present invention to a 0.5 bottle of water suffices to produce an effective, grease-cutting, general purpose cleaner for use on countertops and other household surfaces.

As can be seen from the description, each embodiment of the cleaning agent in accordance with the present invention solves a problem by addressing the need for a natural, non-irritating, microbe-spread-inhibiting, aesthetically pleasing cleaning product.

While the specification describes particular embodiments of the present invention, those of ordinary skill can devise variations of the present invention without departing from the inventive concept.

We claim:

1. A laundry or household cleaning agent, comprising:

a diluent comprising approximately 50% by volume of a soapy composition, said soapy composition being prepared by boiling soap nuts in water for thirty minutes (30 min.), the proportion being from 4 to 16 soap nuts per liter of water, thereafter compressing the mixture to reduce the soap nuts to a pulp, and filtering the composition until it is free of soap nut pulp, said diluent comprising approximately 50% by volume of glycerin;

said cleaning agent comprising from 0.02% to 0.32% by volume of each of first, second, third, and fourth essential oils, each of said oils being selected from the group consisting of lemongrass essential oil, geranium essential oil, tea tree essential oil, lavender oil, myrrh oil, and oregano oil; and said cleaning agent comprising from 0.3% to 6.0% by volume of polysorbate 20.

2. The cleaning agent of claim 1, wherein:

said soapy composition is prepared with from 6 to 12 soap nuts per liter of water;

said cleaning agent comprises from 0.06% to 0.12% by volume of each of said oils; and said cleaning agent comprises from 0.6% to 3.0% by volume of polysorbate 20.

3. The cleaning agent of claim 1, wherein:

said soapy composition is prepared with from 8 to 10 soap nuts per liter of water;

said cleaning agent comprises from 0.08% to 0.10% by volume of each of said oils; and said cleaning agent comprises from 1.3% to 1.5% by volume of polysorbate 20.

4. The cleaning agent of claim 1, said water being deionized water.

5. The cleaning agent of claim 1, said water being distilled water.

6. The cleaning agent of claim 1, said oils being selected as lemongrass essential oil, geranium essential oil, tea tree essential oil, and lavender oil.

7. The cleaning agent of claim 1, comprising 0.02% to 0.32% by volume of liquid grapefruit seed extract.

8. A laundry or household method of cleaning and reducing transfer of unwanted microorganisms, the method including the steps of:

providing a cleaning agent, said cleaning agent comprising:

a diluent comprising approximately 50% by volume of a soapy composition, said soapy composition being prepared by boiling soap nuts in water for thirty minutes (30 min.), the proportion being from 4 to 16 soap nuts per liter of water, thereafter compressing the mixture to reduce the soap nuts to a pulp, and filtering the composition until it is free of soap nut pulp, said diluent also comprising approximately 50% by volume of glycerin;

said cleaning agent comprising from 0.02% to 0.32% by volume of each of first, second, third, and fourth essential oils, each of said oils being selected from the group consisting of lemongrass essential oil, geranium essential oil, tea tree essential oil, lavender oil, myrrh oil, and oregano oil; and said cleaning agent comprising from 0.3% to 6.0% by volume of polysorbate 20.

dispensing said cleaning agent in an effective quantity in a cleaning procedure; and performing the cleaning procedure.

9. The method of claim 6, said water being deionized water.

10. The method of claim 6, said water being distilled water.

11. The method of claim 6, wherein said step of dispensing includes a step of adding said cleaning agent in an effective quantity to a load of laundry; and said step of performing includes steps of washing, rinsing, and drying the load of laundry.

12. The cleaning composition of claim 6, comprising a fifth oil, namely, oregano oil, present in a concentration of from 0.08% to 0.10% by volume.

13. The cleaning composition of claim 12, comprising 0.02% to 0.32% by volume of liquid grapefruit seed extract.

* * * * *